US011666087B2

(12) United States Patent
Touzjian

(10) Patent No.: US 11,666,087 B2
(45) Date of Patent: Jun. 6, 2023

(54) SMOKING APPARATUS WITH QUICK-SEAL ATTACHMENT ASSEMBLY

(71) Applicant: Vick Touzjian, Glendale, CA (US)

(72) Inventor: Vick Touzjian, Glendale, CA (US)

( * ) Notice: Subject to any disclaimer, the term of this patent is extended or adjusted under 35 U.S.C. 154(b) by 378 days.

(21) Appl. No.: 16/950,057

(22) Filed: Nov. 17, 2020

(65) Prior Publication Data

US 2022/0151289 A1 May 19, 2022

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 3,881,499 A * 5/1975 McFadden ..... A24F 1/30 131/222
2008/0302885 A1* 12/2008 O'Brien ..... B05B 7/2443 239/310
2009/0095310 A1* 4/2009 Chaoui ..... A24F 1/30 131/173

* cited by examiner

*Primary Examiner* — Dennis R Cordray
(74) *Attorney, Agent, or Firm* — Cohen IP Law Group, PC; Michael N. Cohen

(57) ABSTRACT

A smoking apparatus including a quick-seal attachment assembly. The smoking apparatus includes an upper portion including a bowl and a lower portion including a water base. The quick-seal attachment assembly includes a first attachment mechanism configured with the upper portion of the smoking apparatus and a second attachment mechanism configured with the lower portion. The upper portion and the lower portion are disconnected and/or reconnected to one another by engaging the first and second attachment mechanisms and by applying a partial twist of the upper portion of the smoking apparatus with respect to the lower portion.

20 Claims, 7 Drawing Sheets

SMOKING APPARATUS WITH QUICK-SEAL ATTACHMENT ASSEMBLY

FIELD OF THE INVENTION

This invention relates to smoking apparatuses, including smoking apparatuses with quick-seal attachment assemblies.

BACKGROUND

Smoking apparatuses used to smoke tobacco, flavored shisha, and other types of smokable materials are found throughout the world. One of the more popular smoking apparatuses includes the hookah pipe that works by passing the smoke through a basin of water before it is inhaled by the user.

Because hookah pipes include a water-filled base, it is important that the hookah be dismantlable, so that the water base may be removed, cleaned, and filled with fresh water as needed. Upon reconfiguring the hookah, it is especially important that the seal between the water base and the body of the pipe be secure, airtight, and watertight.

Current methods of attaching the hookah's water base to the body of the pipe include several different techniques. In a first example, some designs provide a rubber stopper configured with the bottom of the pipe's body that is simply pressed into the upper opening of the water base. While this design may work for a while, the rubber stopper may oftentimes become worn such that the seal between the water base and the pipe's body may begin to leak during use. In addition, this design is prone to inadvertent separation (being pressure fit) leading to the spilling and even the breaking of the water base.

In another example, the top of the water base may include standard threading that may be screwed into the bottom of the pipe's bottom (also threaded). However, this technique is quite cumbersome and time consuming, and often leads to an insufficient seal between the parts. In addition, some designs may include a circumferential gasket, however, the gasket is positioned on the outside of the threaded water base element, thereby exposing the gasket to outside elements that may compromise the gasket over time. This may lead to the gasket becoming damaged or even broken and lost.

Accordingly, there is a need for a hookah pipe that includes a quick-seal attachment assembly to provide consistent and robust connections between the water base and the body of the pipe. There also is a need for a hookah pipe attachment assembly that positions a sealing gasket within its inner volume to protect the gasket from damage and/or breakage.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, the smoking assembly according to exemplary embodiments hereof includes a smoking apparatus (e.g., a hookah, a water pipe, etc.) including an upper portion and a lower portion connected together by a quick-seal attachment assembly. In some embodiments, the upper portion of the smoking assembly generally comprises (i) a bowl for containing and combusting the smokable material(s) (e.g., tobacco, flavored shisha, etc.), (ii) a plate, (iii) an upper body, and (iv) a water stem. The lower portion generally comprises a water base (also referred to as a vase). The quick-seal attachment assembly generally provides a quick, easy, and airtight connection between the upper body and the water base. The quick-seal attachment system also may be used at the junctions between other components of the smoking apparatus (e.g., between the plate and the upper body, between the water stem and the upper body, etc.). Some elements of the smoking apparatus also may be configured with the quick-seal attachment assembly, such as, without limitation, one or more smoking hoses, and a smoke release valve.

In some embodiments, the quick-seal attachment assembly includes an upper attachment portion and a lower attachment portion. The upper attachment portion includes an upper housing defining an inner volume comprising one or more sidewall ridges. The lower attachment portion includes a lower housing comprising one or more outer circumferential wedges. In general, a portion of the lower housing including the outer circumferential wedges is received into the upper housing's inner volume, where the sidewall ridges are adapted to engage the circumferential wedges thereby securing the upper and lower attachment portions together. This in effect secures the upper portion and the lower portions of the smoking apparatus together.

As will be described in detail in other sections, the upper housing side wall ridges and the lower housing circumferential wedges may be engaged by inserting the top of the lower housing into the bottom of the upper housing and turning the upper and/or lower housings in opposite directions relative to one another. In a preferred embodiment, the upper and lower housings are engaged using a one-quarter turn (e.g., 90°) relative to one another.

It is understood that the example described above is meant for demonstration and that the smoking assembly may comprise only some of and/or additional elements as described herein or otherwise.

Figure 1:
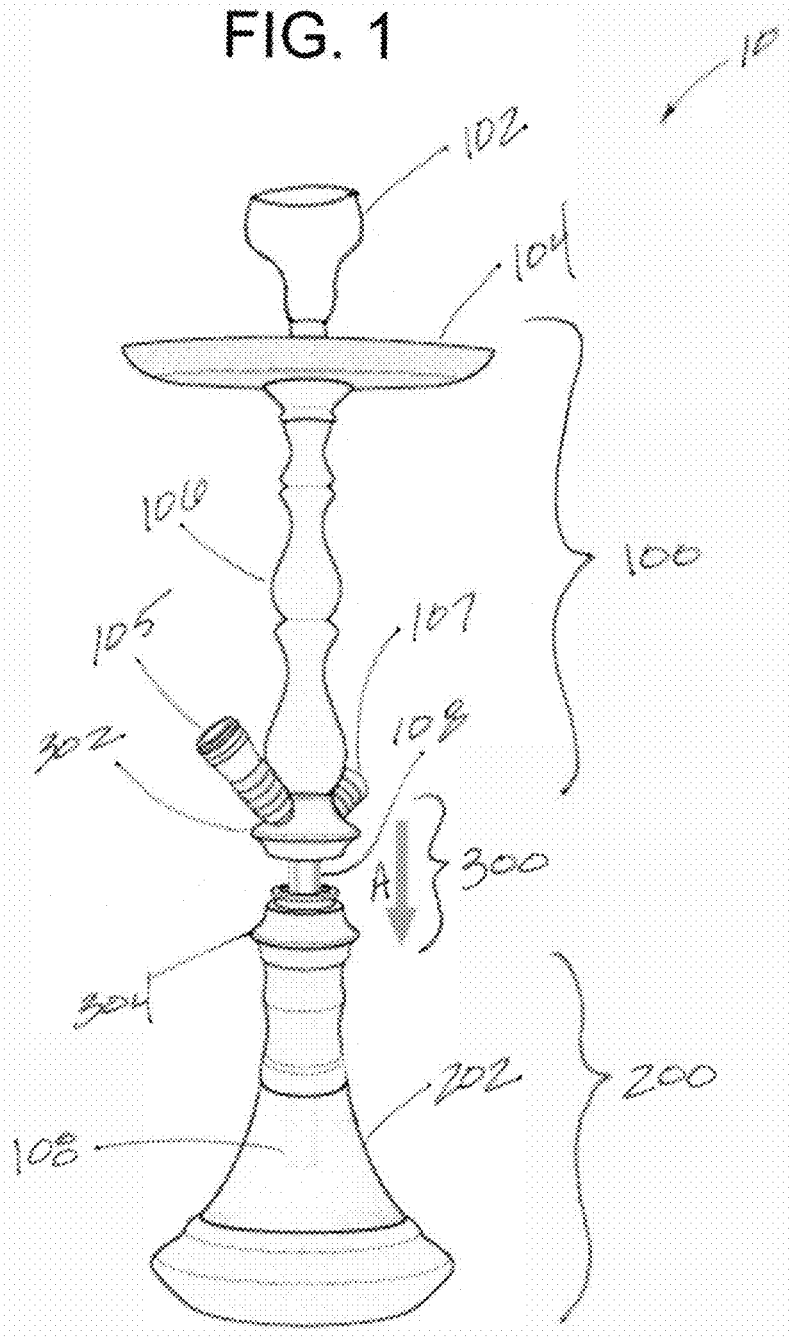
FIGS. 1-2 show schematic views of a smoking apparatus with a quick-seal attachment assembly according to exemplary embodiments hereof.
Figure 2:
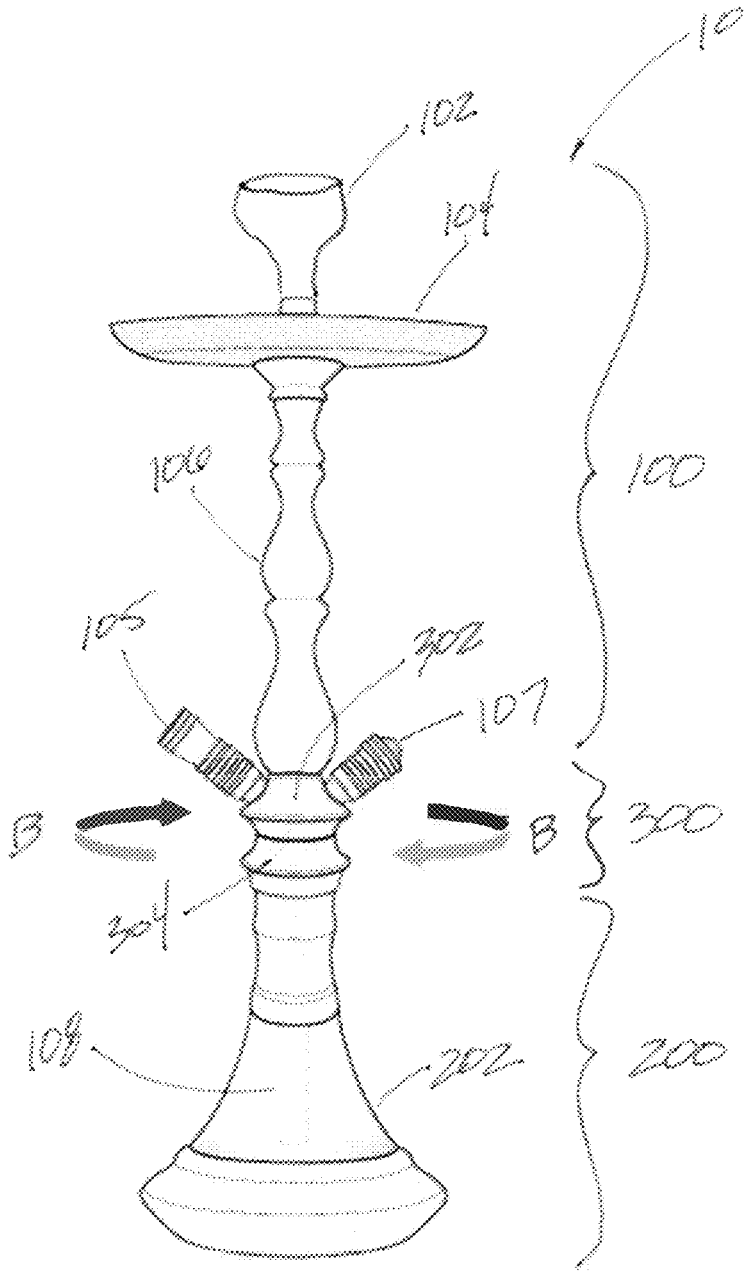

In one exemplary embodiment hereof, as shown in FIGS. 1-2, the smoking assembly 10 includes an upper portion 100, a lower portion 200, and a quick-seal attachment assembly 300 adapted to releasably connect the upper portion 100 to the lower portion 200 for use of the assembly 10. FIG. 1 depicts the upper portion 100 and the lower portion 200 disconnected from one another (and being connected by moving the upper portion 100 downward (e.g., in the direction of arrow A) onto the lower portion 200), and FIG. 2 depicts the upper and lower portions 100, 200 mated by turning the portions 100, 200 relative to one another (e.g., in the direction of arrows B) to form the overall smoking assembly 10. The smoking assembly 10 also may include other elements and/or components as necessary to perform its functionalities.

Note that the portions 100, 200, and assembly 300 are depicted as basic shapes to represent the general configuration of the elements 100, 200, 300 with respect to one another. However, it is understood that the representations do not necessarily represent the size, shape and/or form of the elements 100, 200, 300, nor the proportional sizes of the elements 100, 200, 300 with respect to one another. These details will be described in other sections.

Upper Portion 100

In one some embodiments hereof as shown in FIGS. 1-2, the upper portion 100 includes (I) a bowl 102 for containing and combusting the smokable material(s) (e.g., tobacco, flavored shisha, etc.), (ii) a plate 104, (iii) an upper body 106, and (iv) a water stem 108. In some embodiments, the upper portion 100 also may include one or more a smoking hoses 105, and a smoke release valve 107. However, in other embodiments, the hose(s) 105 and/or the release valve 107 may be configured with the quick-seal attachment assembly 300.

The upper body 106 includes an outer shell defining an inner volume extending from the top end of the upper body 106 to its bottom end. In some embodiments, the bowl 102 is configured with the top end of the upper body 106 and the water stem 108 is configured with the bottom end of the upper body 106. In this way, the upper body 106 provides fluid communication between the bowl 102 and the water stem 108.

The lower end of the upper body 106 may be adapted to be attached to the upper end of the quick-seal attachment mechanism 300 via corresponding threads (so that the elements may be screwed together), pressure fit, slots and detent combinations, adhesive, chalking, other attachment methods and any combinations thereof. It is preferable that the seal between the lower end of the upper body 106 and the upper end of the attachment mechanism 300 be airtight and watertight.

In addition, the water stem 108 may be adapted to extend downward from the lower end of the upper body 106 a sufficient length so that the water stem 108 may pass through the inner volume of the quick-seal attachment assembly 300 and into the water base of the lower portion 200 when the smoking apparatus 10 is fully assembled.

Lower Portion 200

In some embodiments hereof as shown in FIGS. 1-2, the lower portion 200 includes a water base 202 (also referred to as a vase) comprising a container adapted to hold a volume of water. It may be preferable that the water base 202 include a generally flat lower surface so that the water base 202 may rest upright on a flat surface (e.g., a tabletop) and provide stability to the overall smoking assembly 10 in this configuration.

The top end (the throat) of the water base 202 may be adapted to be attached to the lower end of the quick-seal attachment mechanism 300 via corresponding threads (so that the elements may be screwed together), pressure fit, slots and detent combinations, adhesive, caulking, other attachment methods and any combinations thereof. It is preferable that the seal between the upper end of the water base 202 and the lower end of the attachment mechanism 300 be airtight and watertight.

Quick-Seal Attachment Assembly 300

Figure 3:
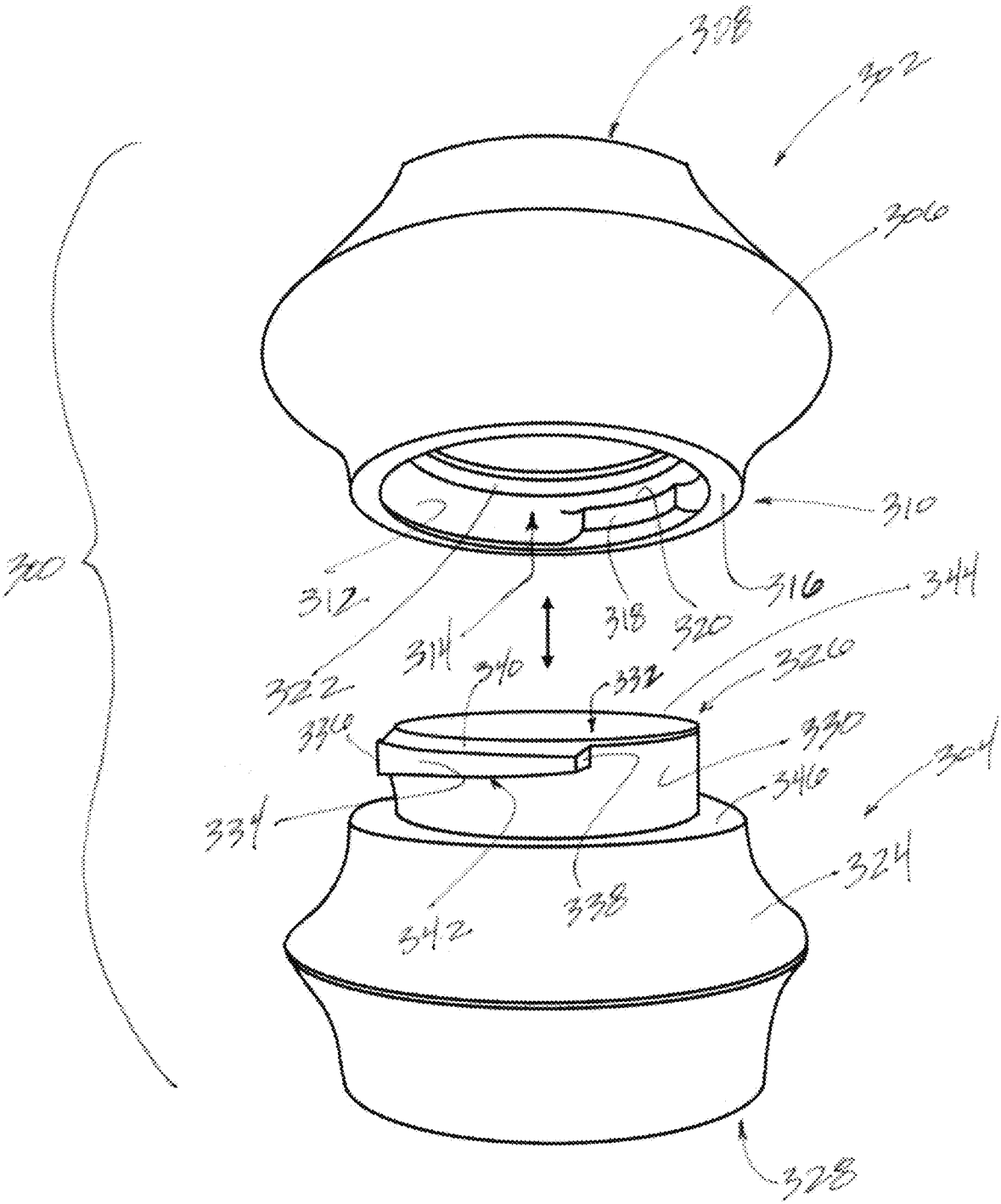
FIGS. 3-4 shows a schematic of a smoking apparatus quick-seal attachment assembly according to exemplary embodiments hereof.
Figure 4:
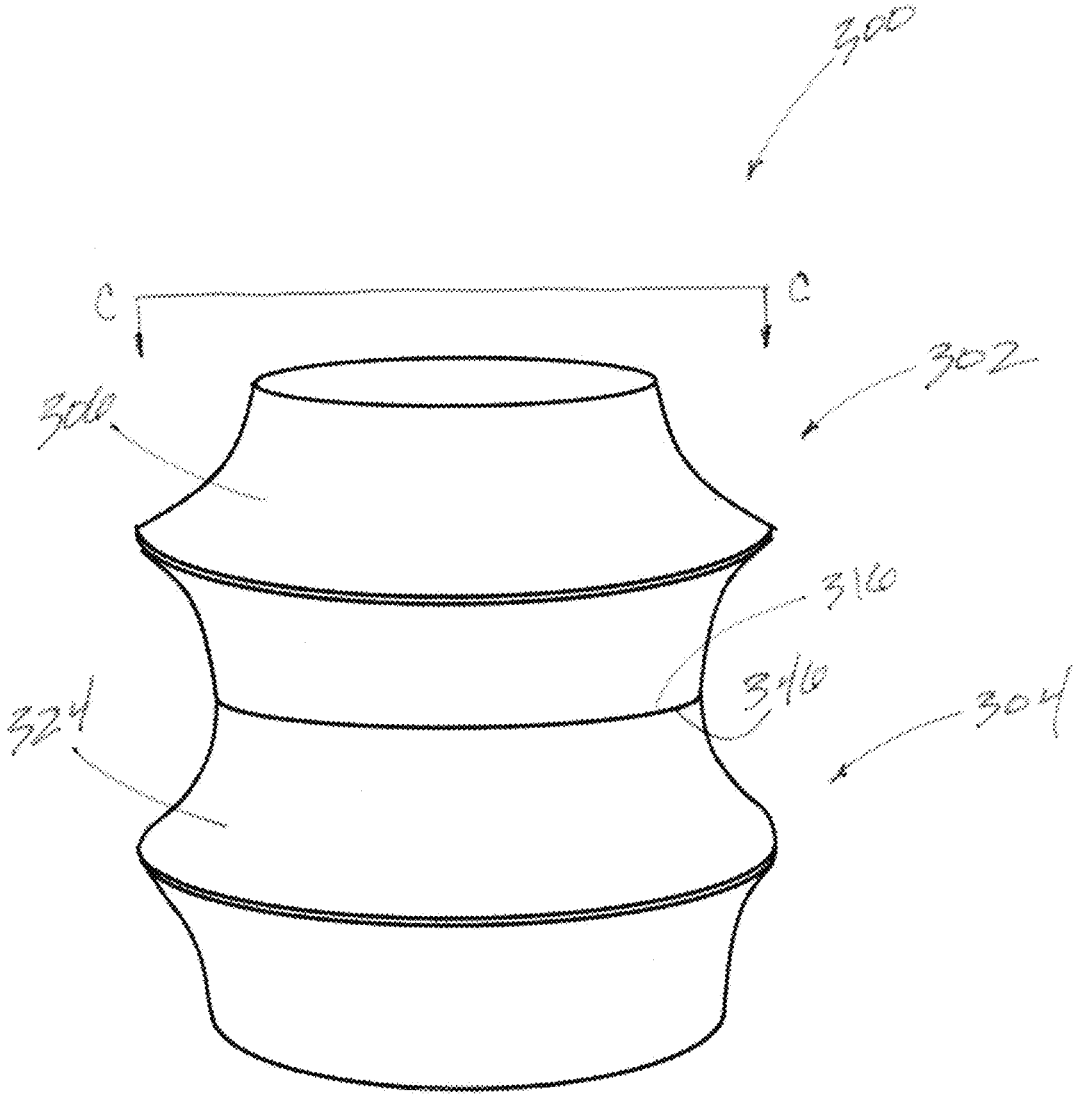

In some embodiments hereof as shown in FIGS. 3-4, the quick-seal attachment assembly 300 includes a first attachment portion 302 (e.g., the upper portion) and a second attachment portion 304 (e.g., the lower portion) adapted to be attached to one another and subsequently detached from one another as described herein. FIG. 3 depicts the first and second attachment portions 302, 304 detached from one another, and FIG. 4 depicts the first and second attachment portions 302, 304 attached to one another (interlocked).

Figure 5:
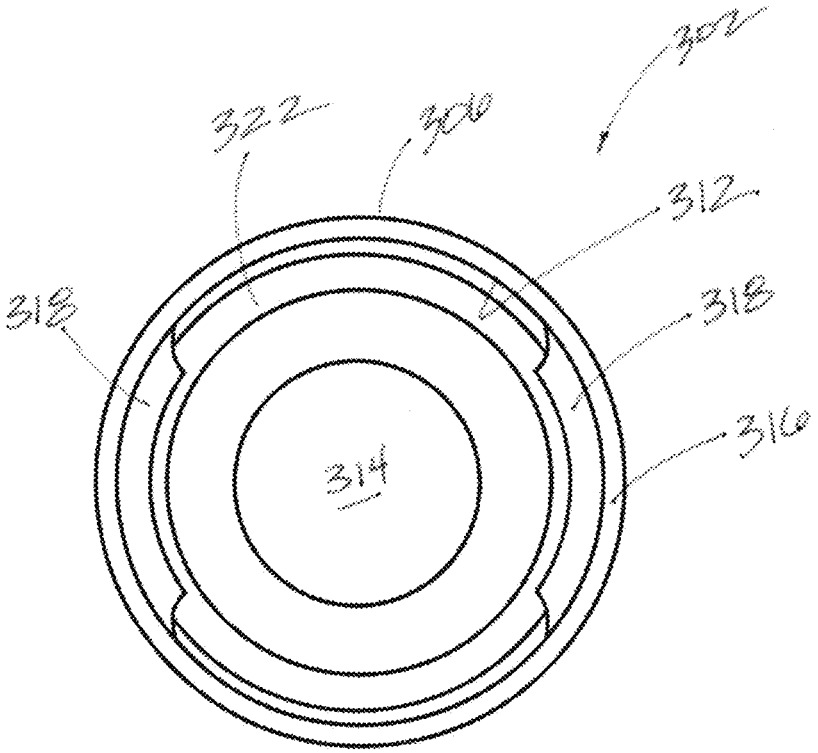
FIG. 5 shows a bottom view of a smoking apparatus quick-seal attachment assembly first portion according to exemplary embodiments hereof.

In some embodiments as shown in FIGS. 3 and 5, the first attachment portion 302 includes a first housing 306 including a top 308, a bottom 310 and an inner circumferential surface 312 (also referred to as an inner sidewall) defining an inner volume 314. The inner volume 314 may pass from the top 308 to the bottom 310.

As described above, the lower end of the smoking assembly's upper portion 100 (e.g., the body 106) may be attached to the top 308 of the first attachment portion 302 using any suitable means. In addition, once configured in this manner, the water stem 108 may extend downward from the bottom end of the body 106, through the inner volume 314, and out the bottom 310 of the first attachment portion 302 an adequate distance so as to be adequately received into the water base 202 when the smoking apparatus 10 is fully assembled. This is shown in FIGS. 1-2.

The first attachment portion's bottom 310 may include a bottom surface 316 adjacent the inner circumferential surface 312. The circumferential surface 312 may accordingly extend from the bottom surface 316 upward into the inner volume 314.

FIG. 5 depicts the first attachment portion 302 looking directly into its bottom 310. In some embodiments, the first attachment portion 302 includes one or more inner ridges 318 configured with the inner circumferential surface 312 (the inner side walls). The inner ridges 318 generally extend inward from the inner circumferential surface 312 into the inner volume 314. Each inner ridge 318 may generally follow the curvature of the inner circumferential surface 312 and may subsequently extend about the inner circumferential surface 312 as an arc. Each inner ridge 318 may extend a portion of the circumference of the inner circumferential surface 312 (e.g., 30°-60°, more or less) such that there are gaps between the inner ridges 318 about the inner circumferential surface 312. It is preferable that each inner ridge 318 be equivalent to each other inner ridge 318 in shape and/or size, and that the ridges 318 are aligned with one another in the vertical plane. However, this may not be required.

While FIG. 5 depicts a total of two inner ridges 318, the first attachment portion 302 may include one, three, four or more inner ridges 318.

In some embodiments, each inner ridge 318 includes an upper surface 320 adapted to engage one or more surfaces of one or more elements of the second attachment portion 304 as described in other sections. In some embodiments, the upper surface 320 may be generally flat and horizontal while in other embodiments the upper surface 320 may be angled from end-to-end.

In some embodiments, the first attachment portion 302 includes an inner circumferential gasket 322 (also referred to as an O-ring, a sealing ring or a sealing member) configured with the inner circumferential surface 312 above the inner ridges 318 (as depicted in FIG. 3). The inner circumferential surface 312 may include a circumferential notch or channel 323 adapted to receive a portion of the O-ring 322 to secure the O-ring to the surface 312. In this way, the O-ring 322 is held within the inner volume 314 of the first portion 302 above the inner ridges 318 as shown. As will be described in other sections, the O-ring 322 provides an airtight and watertight seal between the first and second attachment portions 302, 304 when the portions 302, 304 are mated.

Figure 6:
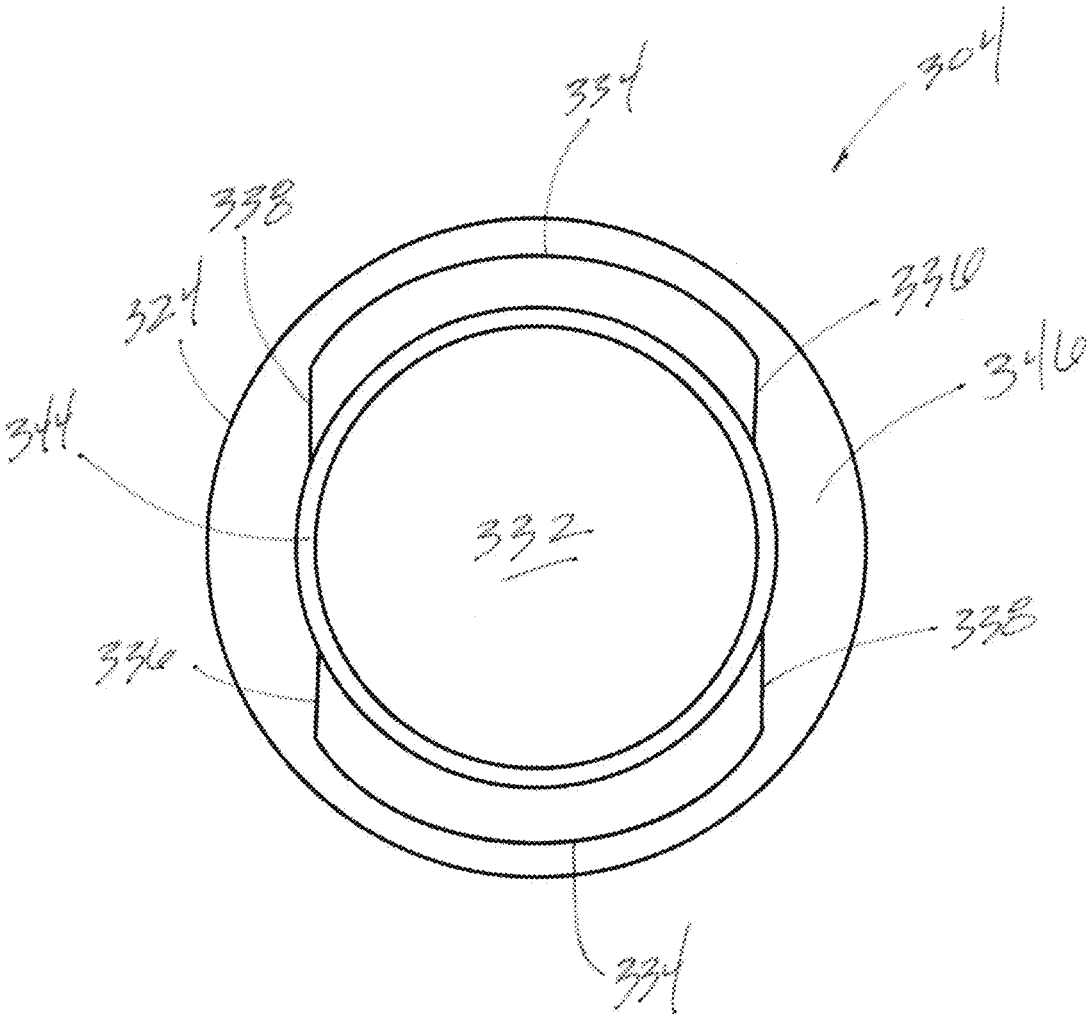
FIG. 6 shows a top view of a smoking apparatus quick-seal attachment assembly second portion according to exemplary embodiments hereof.

In some embodiments as shown in FIGS. 3 and 6, the second attachment portion 304 includes a second housing 324 including a top 326, a bottom 328, an outer circumferential surface 330 (also referred to as an outer sidewall) and an inner volume 332. The inner volume 322 may pass from the top 326 to the bottom 328.

As described above, the upper end of the smoking assembly's lower portion 200 (e.g., the throat of the water base 202) may be attached to the bottom 328 of the second attachment portion 304 using any suitable means.

FIG. 6 depicts the second attachment portion 304 looking directly into its top 326. In some embodiments, the second attachment portion 304 includes one or more outer wedges 334 configured with the outer circumferential surface 330 (the outer side walls). The outer wedges 334 generally extend outward from the outer circumferential surface 330 away from the surface 330. Each outer wedge 334 may generally follow the curvature of the outer circumferential surface 330 and may subsequently extend about the outer circumferential surface 330 as an arc. Each outer wedge 334 may extend a portion of the circumference of the outer circumferential surface 330 (e.g., 45°-120°, more or less) such that there are gaps between the outer wedges 334 about the outer circumferential surface 330. It is preferable that each outer wedge 334 be equivalent to each other outer wedge 334 in shape and/or size, and that the wedges 334 are aligned with one another in the vertical plane. However, this may not be required.

While FIG. 6 depicts a total of two outer wedges 334, the second attachment portion 304 may include one, three, four or more outer wedges 334. In general, the number of outer wedges 334 may preferably match the number of inner ridges 318 on the first attachment portion 302.

In some embodiments, each outer wedge 334 includes a first end 336 and a second end 338, and the wedge 334 may taper from the first end 336 to the second end 338 in the vertical plane. That is, the height of the wedge 334 may decrease from the wedge height at the first end 336 to the wedge height at the second end 338. In some embodiments, the taper may include a linear taper from end-to-end 336, 338 while in other embodiments the taper may include a curved taper.

In some embodiments, each outer wedge 334 includes an upper surface 340 and a lower surface 342. In some embodiments, the tapering of each outer wedge 334 occurs along the lower surface 340. That is, the upper surface 340 may remain generally horizontal from the first end 336 to the second end 338 while the lower surface 342 may angle upward from the first end 336 to the second end 338, thereby forming the wedge-shaped outer wedge 334.

In other embodiments, the outer wedge 334 may be formed as an angled ridge with the upper surface 340 and the lower surface 342 both angled upward from first end 336 to the second end 338 to form the wedge functionality (that is, the wedge functionality provided by the ridge's upward angled lower surface 342). In these embodiments, the upper surface 340 may be parallel to the lower surface 342, however, this may not be required. It is understood that in these embodiments and for the purposes of this specification, the definition of the wedge 334 incudes that of an angled ridge 334 with the lower surface 342 of the angled ridge 334 providing an equivalent functionality as the lower surface 342 of the wedge 334 as described in other sections. For example, the wedge 334 may include a linear ridge extending from its first end 336 to its second end 338 at an acute angle.

In some embodiments, when the upper surface 320 of the inner ridge 318 is angled from end-to-end to provide a wedge effect, the lower surface 342 may not be angled and instead may extend flat and generally horizontally from the first end 336 to the second end 338. In this way, the upper surface 320 of the inner ridge 318 provides the wedge effect to translate rotational forces to vertical linear forces as described in other sections.

In some embodiments, when the first and second attachment portions 302, 304 are mated, the lower surface 342 of each outer wedge 334 is adapted to engage with a corresponding upper surface 320 on a corresponding inner ridge 318. This will be described in other sections.

In some embodiments, the top 326 of the second attachment portion 304 includes an upper surface 344 adapted to engage the O-ring 322 configured within the inner volume 314 of the first attachment portion 302 when the first and second attachment portions 302, 304 are mated. The junction between the upper surface 344 and the O-ring 322 provides an airtight and watertight seal between the attachment portions 302, 304.

In some embodiments, the second portion 302 includes a circumferential shelf 346 extending outward from the outer circumferential surface 330 at a position below the outer wedges 334. When the first and second attachment portions 302, 304 are mated, it may be preferable that the bottom surface 316 of the first attachment portion 302 engage and abut against the circumferential shelf 346 of the second attachment portion 304.

Figure 7:
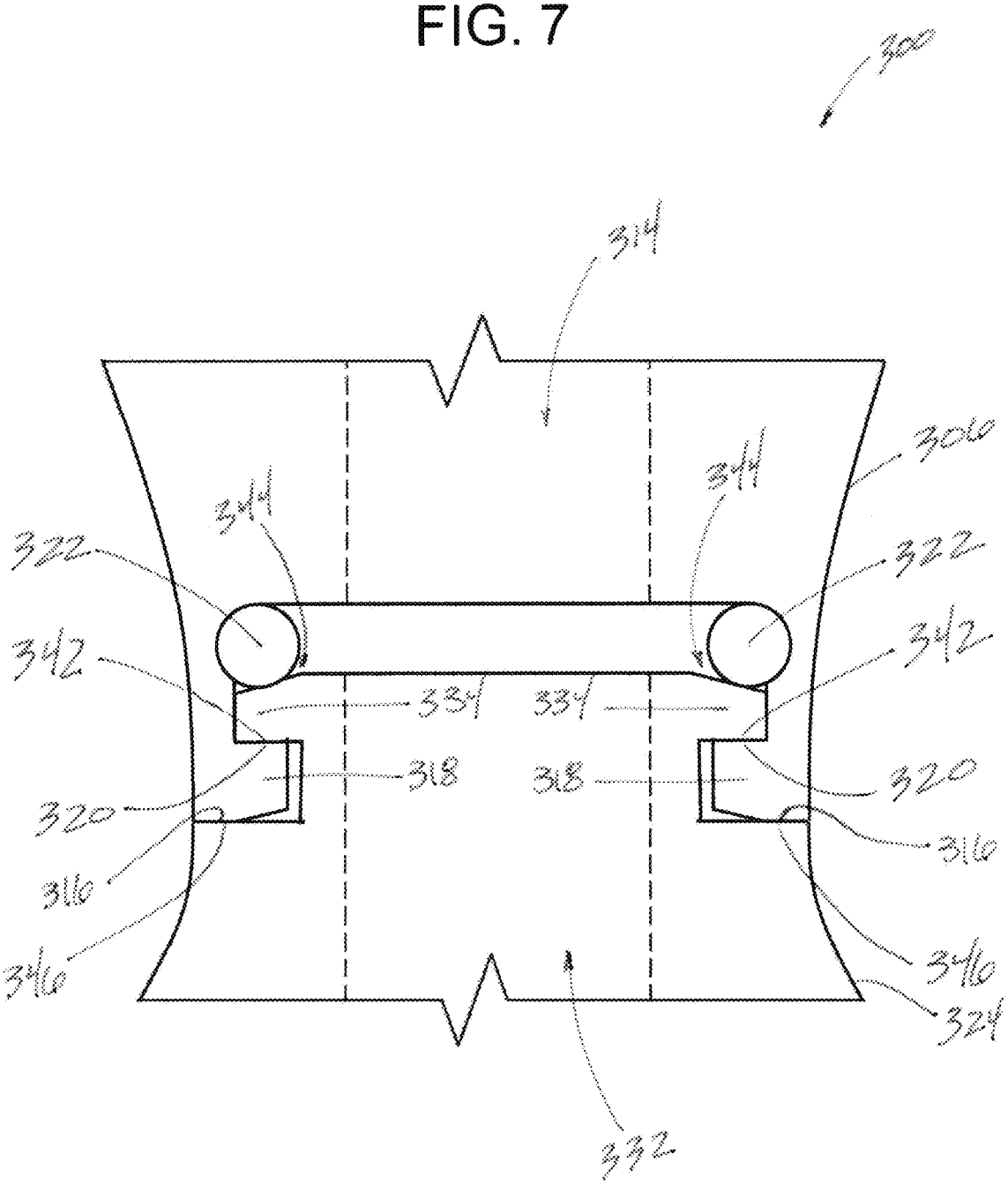
FIG. 7 shows a side cutaway view of a smoking apparatus quick-seal attachment assembly according to exemplary embodiments hereof.

FIG. 7 shows a cutaway view of the quick-seal attachment assembly 300 cut in half along cut-lines C-C of FIG. 4. The quick-seal attachment assembly's second portion 304 has been inserted into the attachment assembly's first portion 302 and mated using a one-quarter turn of the first and second portions 302, 304 relative to one another.

As shown, this results in the at least some (and preferably all of) the following interfaces:

1. The upper surface 320 of each of the first attachment portion's inner ridges 318 are engaged with the lower surfaces 342 of each corresponding second attachment portion's outer wedges 334. This junction effectively secures the first and second attachment portions 302, 304 together.
2. The upper surface 344 of the second attachment portion 304 and/or the upper surface 340 of the second attachment portion's outer wedges 334 are engaged with the O-ring 322 configured within the inner volume 314 of the first attachment portion 302. It may be preferable that this engagement causes the O-ring 322 to compress to ensure an adequate seal. This junction provides an airtight and watertight seal between the first and second attachment portions 302, 304. In addition, because this junction is contained within the inner volume 314 of the first housing 306, the O-ring 322 is held secure and protected from outside elements.
3. The bottom surface 316 of the first housing 306 is engaged with the upper surface of the circumferential shelf 346 on the lower housing 324.

It is understood that in some embodiments, not all and/or additional interfaces may exist between various elements of the first and second attachment portions 302, 304 when the portions 302, 304 are configured together.

In some embodiments, the first and second attachment portions 302, 304 may be reversed such that the second attachment portion 304 is configured with the lower end of the smoking assembly's upper portion 100 (e.g., the body 106) and the first attachment portion 302 may be configured with the upper end of the smoking assembly's lower portion 200 (e.g., the throat of the water base 202).

In Use

In some embodiments as shown in FIG. 1, the smoking apparatus 10 may be assembled by placing the water stem 108 through the inner volume 332 of the second attachment portion 304 from the top 326.

Next, the first attachment portion 302 may be lowered onto the second attachment portion 304 in the direction of the arrow A.

Next, the upper portion of the second attachment portion 304 including the outer circumferential surface 330 and the outer wedges 334 may be received into the inner volume 314 of the first attachment portion 302 from the bottom 310. Note that the first and second attachment portions 302, 304 may require to be oriented with respect to one another so that the outer wedges 334 on the second attachment portion 304 pass through the gaps between the inner ridges 318 on the first attachment portion 302 as the second attachment portion 304 is received into the first attachment portion 302.

The second attachment portion's upper surface 344 may engage the O-ring 322 which may provide a vertical stop to the second attachment portion 302.

In this configuration, the outer wedges 334 and the inner ridges 318 may not yet be engaged. However, the upper surfaces 320 of the inner ridges 318 may be positioned even with or slightly below (in the vertical plane) the lower surface 342 of an adjacent second end 338 (the smaller tapered end 338 compared to the larger opposite end 336) of each corresponding outer wedge 334. This may allow the inner ridges' upper surfaces 320 to properly engage the outer wedges' corresponding lower surfaces 342 when the first and second attachment portions 302, 304 are rotated as described below.

Next, the first and/or second attachment portion(s) 302, 304 may be rotated in opposite directions relative to one another in directions that cause the upper surfaces 320 of the inner ridges 318 to engage with and slide upon the lower surfaces 342 of corresponding adjacent outer wedges 334. This may require that the attachment portions 302, 304 be rotated in directions that cause the inner ridges 318 to engage with the second ends 338 of the outer wedges 334, since the first ends 336 of the wedges 334, being thicker, may obstruct adjacent inner ridges 318.

Note that given the orientations shown in FIG. 3 of the wedges 334 and the direction of the wedge tapers from the wider first ends 336 to the tapered and more narrow second ends 338, that the first and second attachment portions 302, 304 may be rotated in a clockwise direction with respect to one another (as depicted by arrows B of FIG. 2) in order to engage the wedges 334 with the ridges 318. However, it is understood that if the taper of the wedges 334 were to be reversed, that the attachment portions 302, 304 may be rotated in a counter-clockwise direction for proper engagement.

As the first and/or second attachment portion(s) 302, 304 are rotated further, the upper surfaces 320 may slide upon the angled lower surfaces 342 of the wedges 334 creating a wedge effect on the ridges 318. If the upper surfaces 320 also are angled, the wedge effect provided by the angled upper surfaces 320 may compound the overall wedge effect at the mated surfaces 320, 342. Note that it may be preferable that the angle of the upper surface 320 complement the angle of the lower surface 342 so that the opposing surfaces 320, 342 generally mirror one another (e.g., the surfaces 320, 342 may be parallel). However, it is understood that if the upper surface 320 is angled to provide a wedge effect, the lower surface 342 may need not be angled. This wedge effect may translate the rotational forces of the attachment portions 302, 304 into a vertical force pulling the second attachment portion 304 further into the inner volume 314 of the first attachment portion 302. This may cause the upper surface 344 of the second attachment portion 304 to further engage and further compress the O-ring 322 until further compression is no longer achievable. At this point, the first and second attachment portions 302, 304 may be fully engaged and connected in an airtight and watertight fashion.

It may be preferable that the dimensions of the first and second attachment portions 302, 304 and of the outer wedges 334 (e.g., the amount of taper) are chosen such that in this configuration the lower surface 316 of the first attachment portion 302 abuts with the outer shelf 346 of the second attachment portion 304. In this way, the junction between these elements 316, 346 provides a seal between the corresponding outer surfaces of the first and second housings 306, 324.

In addition, one or more outer wedge 334 and inner ridge 318 combinations may include notches and/or detents that may lock the wedges 334 and ridges 318 together when fully engaged.

In this assembled configuration, the quick-seal attachment mechanism 300 provides an airtight seal between the hookah's upper and lower portions 100, 200 with the water stem 108 extending from the upper portion 100 into the water base 202 of the lower portion 200.

To disassemble the smoking apparatus 10, the acts described above may be generally performed in reverse order.

It is understood that the acts described above are meant for demonstration and that not all acts may be required and that additional acts also may be performed. It is also understood that the acts may be performed in any order.

Additional Attachment Junctions

In additional embodiments, the quick-seal attachment mechanism 300 also may be used to provide quick-seal attachment functionalities between other components of the smoking apparatus 10.

For example, in one embodiment, the bowl 102 may be removably coupled to the upper end of the upper portion 100 (e.g., to the upper end of the upper body 106) using a quick-seal attachment mechanism 300. For instance, the lower end of the bowl 102 may be configured with the upper portion 302 of the mechanism 300, and the upper end of the hookah's upper portion 100 may be configured with the lower portion 304 of the mechanism 300. In this way, the upper and lower portions 302, 304 of the quick-seal attachment mechanism 300 may be mated to effectively couple the bowl 102 to the upper portion 100 of the apparatus 10. Note that the bowl 102 alternatively may be coupled with the plate 104 (or any other component of the smoking apparatus 10) using a quick-seal attachment mechanism 300.

In another example, in one embodiment, the plate 104 may be removably coupled to the upper end of the upper portion 100 (e.g., to the upper end of the upper body 106) using a quick-seal attachment mechanism 300. For instance, the lower end of the plate 104 may be configured with the upper portion 302 of the mechanism 300, and the upper end of the hookah's upper portion 100 may be configured with the lower portion 304 of the mechanism 300. In this way, the upper and lower portions 302, 304 of the quick-seal attachment mechanism 300 may be mated to effectively couple the plate 104 to the upper portion 100 of the apparatus 10. Note that the plate 104 alternatively may be coupled with any other component of the smoking apparatus 10 using a quick-seal attachment mechanism 300.

In another example, the plate 104 may include a center aperture that may be adapted to fit over the top 326 and the outer circumferential surface 330 of the second attachment portion 304 of an attachment mechanism 300 so that the plate 104 may rest on the attachment portion's circumferential shelf 346. A first attachment portion 302 may then be secured to the second attachment portion 304 as described in other sections and the plate 104 may be sandwiched and held secure between the circumferential shelf 346 of the second attachment portion 304 and the bottom surface 316 of the first attachment portion 302.

In another example, in one embodiment, the water stem 108 may be removably coupled to the lower end of the upper portion 100 (e.g., to the lower end of the upper body 106) using a quick-seal attachment mechanism 300. For instance, the upper end of the stem 108 may be configured with the lower portion 304 of a mechanism 300, and the lower end of the hookah's upper portion 100 may be configured with the upper portion 302 of the mechanism 300. In this way, the upper and lower portions 302, 304 of the quick-seal attachment mechanism 300 may be mated to effectively couple the stem 108 to the lower end of the upper portion 100 of the apparatus 10. Note that the stem 108 alternatively may be coupled with any other component of the smoking apparatus 10 using a quick-seal attachment mechanism 300.

In another example, in one embodiment, one or more smoking hoses 105 and/or the smoke release valve 107 may be removably coupled to the lower end of the upper portion 100 (e.g., to the lower end of the upper body 106) using a quick-seal attachment mechanism 300. For instance, the proximal end of the hose(s) 105 and/or of the release valve 107 may be configured with the upper portion 302 of the mechanism 300, and the lower end of the hookah's upper portion 100 may be configured with the lower portion 304 of the mechanism 300. In this way, the upper and lower portions 302, 304 of the quick-seal attachment mechanism 300 may be mated to effectively couple the smoking hose(s) 105 and/or the smoke release valve 107 to the lower portion 100 of the apparatus 10. Note that the smoking hose(s) 105 and/or the smoke release valve 107 alternatively may be coupled directly with either the upper portion 302 and/or the lower portion 304 of the quick-seal attachment mechanism 300. It is understood that the smoking hose(s) 105 and/or the smoke release valve 107 may be coupled with any other component of the smoking apparatus 10 using a quick-seal attachment mechanism 300.

It also is understood that any aspect and/or element of any embodiment of the assembly 10 described herein or otherwise may be combined in any way to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. A smoking apparatus comprising:

an upper body portion including an upper end and a lower end in fluid communication with the upper end;

a water base including an upper throat;

a first attachment portion configured with the lower end of the upper body portion and including an inner circumferential surface defining a first inner volume and a first ridge extending a first ridge length circumferentially along the inner circumferential surface and including a first ridge height from the inner circumferential surface into the first inner volume, the first ridge including a first ridge upper surface;

a sealing ring circumferentially coupled to the inner circumferential surface within the first inner volume and positioned above the first ridge upper surface;

a second attachment portion configured with the upper throat of the water base and including an outer circumferential surface including an upper edge and adapted to fit concentrically within the first inner volume, a first wedge extending a first wedge length circumferentially along the outer circumferential surface and extending outward from the outer circumferential surface a first wedge height, the first wedge including a first wedge first end and a first wedge second end opposite the first wedge first end and a first wedge lower surface extending therebetween at a first acute angle with respect to a horizontal plane;

wherein the first wedge lower surface is adapted to engage the first ridge upper surface, and the upper edge of the outer circumferential surface is adapted to engage the sealing ring when the outer circumferential surface of the second attachment portion is inserted into the first inner volume of the first attachment portion.

2. The smoking apparatus of claim 1 wherein the first attachment portion and the second attachment portion are cooperatively configured such that a partial twist of the first attachment portion relative to the second attachment portion while the outer circumferential surface of the second attachment portion is inserted into the first inner volume of the first attachment portion will engage or disengage an interlock between the first attachment portion and the second attachment portion.

3. The smoking apparatus of claim 2 further comprising a lower surface below and adjacent the inner circumferential surface of the first attachment portion and a shelf below and adjacent the outer circumferential surface of the second attachment portion, wherein the lower surface is adapted to engage the shelf when the first attachment portion and the second attachment portion are engaged by the partial twist.

4. The smoking apparatus of claim 2 wherein an engagement of the upper edge of the outer circumferential surface and the sealing ring provides an airtight interface between the first and second attachment portions when the first attachment portion and the second attachment portion are engaged by the partial twist.

5. The smoking apparatus of claim 1 further comprising a bowl configured with the upper end of the upper body portion and a water stem configured with the lower end of the upper body portion.

6. The smoking apparatus of claim 1 further comprising a smoking hose configured with the upper body portion and/or with the first attachment portion.

7. The smoking apparatus of claim 1 further comprising:

a second ridge extending a second ridge length circumferentially along the inner circumferential surface and including a second ridge height from the inner circumferential surface of the first attachment portion into the first inner volume, the second ridge including a second ridge upper surface;

a second wedge extending a second wedge length circumferentially along the outer circumferential surface and extending outward from the outer circumferential surface a second wedge height, the second wedge including a second wedge first end and a second wedge second end opposite the first wedge second end and a second wedge lower surface extending therebetween at a second acute angle with respect to the horizontal plane;

wherein the second wedge lower surface is adapted to engage the second ridge upper surface when the outer circumferential surface of the second attachment portion is inserted into the first inner volume of the first attachment portion.

8. The smoking apparatus of claim 1 wherein the inner circumferential surface includes a circumferential channel, and the sealing ring is circumferentially coupled within the circumferential channel.

9. A smoking apparatus comprising:

an upper body portion including an upper end and a lower end in fluid communication with the upper end;

a water base including an upper throat;

a first attachment portion configured with the lower end of the upper body portion and including an inner sidewall and a first ridge extending a first ridge length along the inner sidewall, the first ridge including a first ridge height away from the inner sidewall and a first ridge upper surface;

a sealing member coupled to the inner sidewall and positioned above the first ridge upper surface;

a second attachment portion configured with the throat of the water base and including an outer sidewall and a first wedge extending a first wedge length along the outer sidewall, the first wedge including a first wedge height away from the outer sidewall and a first wedge lower surface extending at an acute angle with respect to a horizontal plane;

wherein the second attachment portion is adapted to be inserted into the first attachment portion to engage the first wedge lower surface with the first ridge upper surface.

10. The smoking apparatus of claim 9 wherein the first attachment portion and the second attachment portion are cooperatively configured such that a partial twist of the first attachment portion relative to the second attachment portion while the second attachment portion is inserted into the first attachment portion will engage or disengage an interlock between the first attachment portion and the second attachment portion.

11. The smoking apparatus of claim 10 further comprising a lower surface below and adjacent the inner sidewall of the first attachment portion and a shelf below and adjacent the outer sidewall of the second attachment portion, wherein the lower surface is adapted to engage the shelf when the first attachment portion and the second attachment portion are engaged by the partial twist.

12. The smoking apparatus of claim 10 wherein the second attachment portion includes an upper edge adjacent and above the outer sidewall and adapted to engage the sealing member when the first attachment portion and the second attachment portion are engaged by the partial twist.

13. The smoking apparatus of claim 12 wherein engagement of the upper edge of the second attachment portion and the sealing member provides an airtight interface between the first and second attachment portions when the first attachment portion and the second attachment portion are engaged by the partial twist.

14. The smoking apparatus of claim 9 further comprising a bowl configured with the upper end of the upper body portion and a water stem configured with the lower end of the upper body portion.

15. The smoking apparatus of claim 9 further comprising a smoking hose configured with the upper body portion and/or with the first attachment portion.

16. The smoking apparatus of claim 9 further comprising:

a second ridge extending a second ridge length along the inner sidewall of the first attachment portion, the second ridge including a second ridge height away from the inner sidewall and a second ridge upper surface;

a second wedge extending a second wedge length along the outer sidewall of the second attachment portion, the second wedge including a second wedge height away from the outer sidewall and a second wedge lower surface extending at an acute angle with respect to the horizontal plane;

wherein the second wedge lower surface is adapted to engage the second ridge upper surface when the second attachment portion is inserted into the first attachment portion.

17. The smoking apparatus of claim 9 wherein the inner sidewall includes a circumferential channel, and the sealing member is circumferentially coupled within the circumferential channel.

18. A smoking apparatus comprising:

an upper body portion including an upper end and a lower end in fluid communication with the upper end;

a water base including an upper throat;

a first attachment portion configured with the lower end of the upper body portion and including an inner sidewall and a first ridge extending a first ridge length along the inner sidewall, the first ridge including a first ridge height away from the inner sidewall and a first ridge upper surface;

a second attachment portion configured with the throat of the water base and including an outer sidewall and a first wedge extending a first wedge length along the outer sidewall, the first wedge including a first wedge height away from the outer sidewall and a first wedge lower surface extending at an acute angle with respect to a horizontal plane;

wherein the second attachment portion is adapted to be inserted into the first attachment portion to engage the first wedge lower surface with the first ridge upper surface.

19. The smoking apparatus of claim 18 wherein the first attachment portion and the second attachment portion are cooperatively configured such that a partial twist of the first attachment portion relative to the second attachment portion while the second attachment portion is inserted into the first attachment portion will engage or disengage an interlock between the first attachment portion and the second attachment portion.

20. The smoking apparatus of claim 19 further comprising a lower surface below and adjacent the inner sidewall of the first attachment portion and a shelf below and adjacent the outer sidewall of the second attachment portion, wherein the lower surface is adapted to engage the shelf when the first attachment portion and the second attachment portion are engaged by the partial twist.

* * * * *